US011756715B2

(12) United States Patent
Noro

(10) Patent No.: US 11,756,715 B2
(45) Date of Patent: Sep. 12, 2023

(54) SIGNAL CONVERTER

(71) Applicant: YAMAHA CORPORATION, Hamamatsu (JP)

(72) Inventor: Masao Noro, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 17/698,277

(22) Filed: Mar. 18, 2022

(65) Prior Publication Data

US 2022/0310296 A1 Sep. 29, 2022

(30) Foreign Application Priority Data

Mar. 23, 2021 (JP) ..... 2021-049265

(51) Int. Cl.

| | |
|---|---|
| ***H01F 7/08*** | (2006.01) |
| ***H01F 7/02*** | (2006.01) |
| ***H04R 9/02*** | (2006.01) |
| ***H04R 9/04*** | (2006.01) |
| ***H04R 1/04*** | (2006.01) |
| ***H04R 9/08*** | (2006.01) |
| ***H04R 3/00*** | (2006.01) |
| ***H04R 7/12*** | (2006.01) |

(52) U.S. Cl.

CPC ..... *H01F 7/081* (2013.01); *H01F 7/02* (2013.01); *H04R 1/04* (2013.01); *H04R 3/00* (2013.01); *H04R 7/127* (2013.01); *H04R 9/025* (2013.01); *H04R 9/046* (2013.01); *H04R 9/08* (2013.01)

(58) Field of Classification Search

CPC .. H01F 7/081; H01F 7/02; H04R 1/04; H04R 3/00; H04R 7/127; H04R 9/025; H04R 9/046; H04R 9/08; H04R 2209/041

See application file for complete search history.

(56) References Cited

U.S. PATENT DOCUMENTS 1,734,944 A * 11/1929 Green ..... H04R 3/00 381/118

3,940,575 A 2/1976 Bauer (Continued)

FOREIGN PATENT DOCUMENTS

DE 102010010102 B4 * 10/2015 ..... H04R 3/00

OTHER PUBLICATIONS

English machine translation of DE 102010010102 B4 (Naumann et al., Electrodynamic Loudspeaker, Electronic Device For Controlling The Electrodynamic Loudspeaker And Method For Operating The Electronic Device, published Oct. 2015) (Year: 2015).*

*Primary Examiner* — Mark Fischer

(74) *Attorney, Agent, or Firm* — ROSSI, KIMMS & McDOWELL LLP

(57) ABSTRACT

A signal converter includes a magnetic circuit, a diaphragm, a first coil, a second coil, and a variable resistor. The magnetic circuit has a magnetic gap. The diaphragm is disposed over an opening of the magnetic circuit. The first coil is disposed in the magnetic gap and configured to output an electrical signal based on vibration of the diaphragm. The second coil is disposed in the magnetic gap and configured to brake the diaphragm. The variable resistor is connected to a first end and a second end of the second coil and configured to form a closed loop circuit together with the second coil.

14 Claims, 2 Drawing Sheets

(56) References Cited

U.S. PATENT DOCUMENTS

| | | | | |
|---|---|---|---|---|
| 5,148,492 | A * | 9/1992 | Uzawa | H04R 9/08 181/170 |
| 11,026,035 | B1 * | 6/2021 | Doy | H04R 3/04 |
| 2013/0070941 | A1 * | 3/2013 | Akino | H04R 9/08 381/122 |
| 2013/0148841 | A1 * | 6/2013 | Emonts | H04R 3/002 381/400 |

* cited by examiner

SIGNAL CONVERTER

CROSS-REFERENCE TO RELATED APPLICATIONS

The present application claims priority under 35 U.S.C. § 119 to Japanese Patent Application No. 2021-049265, filed Mar. 23, 2021. The contents of this application are incorporated herein by reference in their entirety.

BACKGROUND

Field

The present disclosure relates to a signal converter that converts sound propagating in a medium (e.g., air) into an electrical signal.

Background Art

U.S. Pat. No. 3,940,575 discloses a dynamic microphone that includes a coil provided on a diaphragm and accommodated in a magnetic gap in a magnetic circuit. The diaphragm is vibrated by sound to output, from the coil, a voltage waveform corresponding to the waveform of the sound.

In an electromagnetic conversion system such as a dynamic microphone, a Q-value (which may also be referred to as Q-factor, quality factor) of a vibration system is controlled by: mechanical resistance of a support system supporting a diaphragm; air resistance received by the diaphragm; and electromagnetic braking by a coil in a magnetic field. In the case of a dynamic microphone, however, it is necessary to receive the output from the coil by a microphone amplifier, which has high input impedance. Thus, electromagnetic braking cannot be expected. Generally, the input impedance of a microphone amplifier is several times to several tens of times the output impedance of a microphone. In view of this fact, when a dynamic microphone is designed, the Q-value is adjusted by adjusting air resistance using a gap or the like between the coil on the back side of the diaphragm and a chamber. For this reason, the Q-value of a dynamic microphone is a fixed value on an individual-microphone basis, and this has made it difficult for a user to adjust the Q-value of the microphone so as to obtain desired sound quality.

The present development has been made in view of the above-described circumstances, and has an object to provide a signal converter that enables a user to easily adjust a Q-value.

SUMMARY

One aspect is a signal converter that includes a magnetic circuit, a diaphragm, a first coil, a second coil, and a variable resistor. The magnetic circuit has a magnetic gap. The diaphragm is disposed over an opening of the magnetic circuit. The first coil is disposed in the magnetic gap and configured to output an electrical signal based on vibration of the diaphragm. The second coil is disposed in the magnetic gap and configured to brake the diaphragm. The variable resistor is connected to a first end and a second end of the second coil and configured to form a closed loop circuit together with the second coil.

BRIEF DESCRIPTION OF THE DRAWINGS

A more complete appreciation of the present disclosure and many of the attendant advantages thereof will be readily obtained as the same becomes better understood by reference to the following detailed description when considered in connection with the following figures.

DESCRIPTION OF THE EMBODIMENTS

The present development is applicable to a signal converter.

Figure 1:
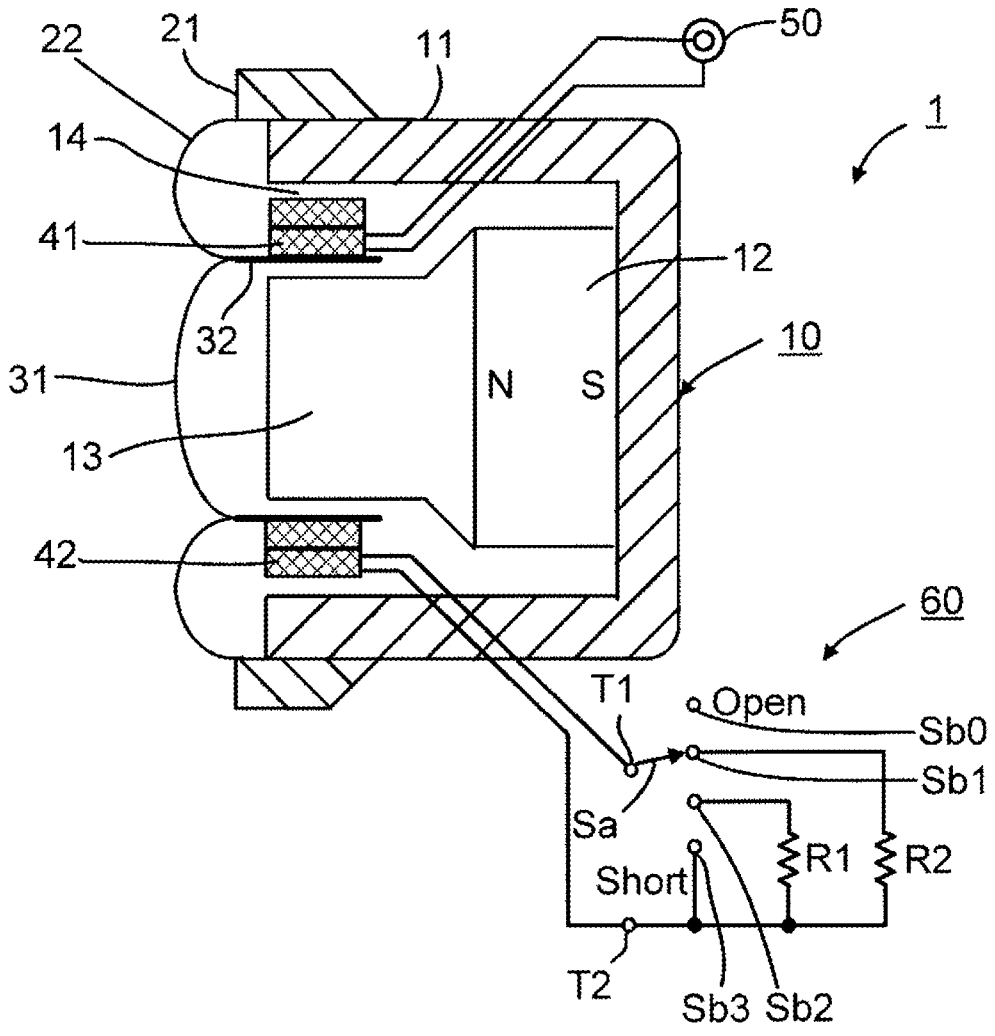
FIG. 1 is a cross-sectional view of a signal converter according to an embodiment of the present disclosure, illustrating a configuration of the signal converter.

The embodiments will now be described with reference to the accompanying drawings, wherein like reference numerals designate corresponding or identical elements throughout the various drawing. FIG. 1 is a cross-sectional view of a signal converter 1 according to an embodiment of the present disclosure, illustrating a configuration of the signal converter 1. Referring to FIG. 1, the signal converter 1 includes a magnetic circuit 10, a hollow cylindrical chamber 11, a cylindrical permanent magnet 12, and a substantially cylindrical inner yoke 13. The permanent magnet 12 has an S-magnetic surface and an N-magnetic surface. The S-magnetic surface is disposed at the bottom of the permanent magnet 12. The inner yoke 13 is disposed on the N-magnetic surface of the permanent magnet 12. The chamber 11, the permanent magnet 12, and the inner yoke 13 constitute the magnetic circuit 10. In the magnetic circuit 10, a magnetic gap 14 is defined between the outer surface of the internal yoke 13 and the inner surface of the chamber 11. In the magnetic gap 14, a magnetic field that is based on the permanent magnet 12 is generated.

A substantially annular support 21 is fixed to an upper end portion of the outer surface of the chamber 11. A substantially dome-shaped diaphragm 31 is supported on the inner side of the support 21 via a substantially annular plate-shaped edge 22. A hollow cylindrical voice coil bobbin 32 is provided on the outer periphery of the diaphragm 31. The voice coil bobbin 32 is accommodated in the magnetic gap 14. A first coil 41 is wound around the voice coil bobbin 32, and a second coil 42 is wound around the outside of the first coil 41.

The first coil 41 is disposed in the magnetic gap 14 and outputs an electric signal based on vibration of the diaphragm 31. A first end of the first coil 41 is connected to one of an inner contact and an outer contact of a plug 50, which is for taking out an electric signal. A second end of the first coil 41 is connected to the other one of the inner contact and the outer contact of the plug 50. Normally, the first coil 41 is connected via the plug 50 to a microphone amplifier (not illustrated) having high input impedance. The second coil 42 is disposed in the magnetic gap 14, similarly to the first coil 41, and brakes the diaphragm 31. A first end of the second coil 42 is connected to one of a first terminal T1 and a second terminal T2 of a variable resistor 60 (potentiometer). A leading end of the second coil 42 is connected to one of the first terminal T1 and the second terminal T2 of the variable resistor 60. The variable resistor 60 forms a closed loop circuit together with the second coil 42.

The variable resistor 60 includes the first terminal T1, the second terminal T2, a movable contact Sa, and fixed contact points Sb0 to Sb3. The movable contact Sa is connected to the first terminal T1. The connection between the fixed contact point Sb0 and the second terminal T2 is open. A resistance R2 is connected to and between the fixed contact point Sb1 and the second terminal Sb2. A resistance R1 is connected to and between the fixed contact point Sb2 and the second terminal T2. The resistance R1 has a resistance value smaller than the resistance value of the resistance R2. The fixed contact point Sb3 and the second terminal T2 are short-circuited. By handling the movable contact Sa, the user is able to select, from among the fixed contact points Sb0 to Sb3, the fixed contact point with which to bring the movable contact Sa into contact. In this manner, the user is able to switch the value of the resistance inserted between the first end and the second end of the second coil 42.

In this embodiment, when the diaphragm 31 vibrates upon receipt of sound, the first coils 41 and 42 vibrate in the magnetic field of the magnetic gap 14, following the vibration of the diaphragm 31. As a result, electromotive force is induced in each of the first coil 41 and the second coil 42.

The electromotive force induced in the first coil 41 is supplied to the plug 50 as an electrical signal indicative of the waveform of the received sound. The electromotive force induced in the second coil 42 causes current to flow through the closed loop circuit including the second coil 42 and the variable resistor 60. By the current flowing through the second coil 42 in this manner, the diaphragm 31 is braked. The force of braking the diaphragm 31 increases as the current flowing through the second coil 42 increases. It is to be noted that although electromagnetic braking is in effect due to the current flowing through the first coil 41, the braking force is small, as described above.

When the diaphragm 31 is braked by the second coil 42, the Q-value of the frequency response of the signal converter 1 becomes lower than when the diaphragm 31 is not braked. Also, the degree of decrease in the Q-value increases as the current flowing through the second coil 42 increases and the force of braking the diaphragm 31 increases.

Figure 2:
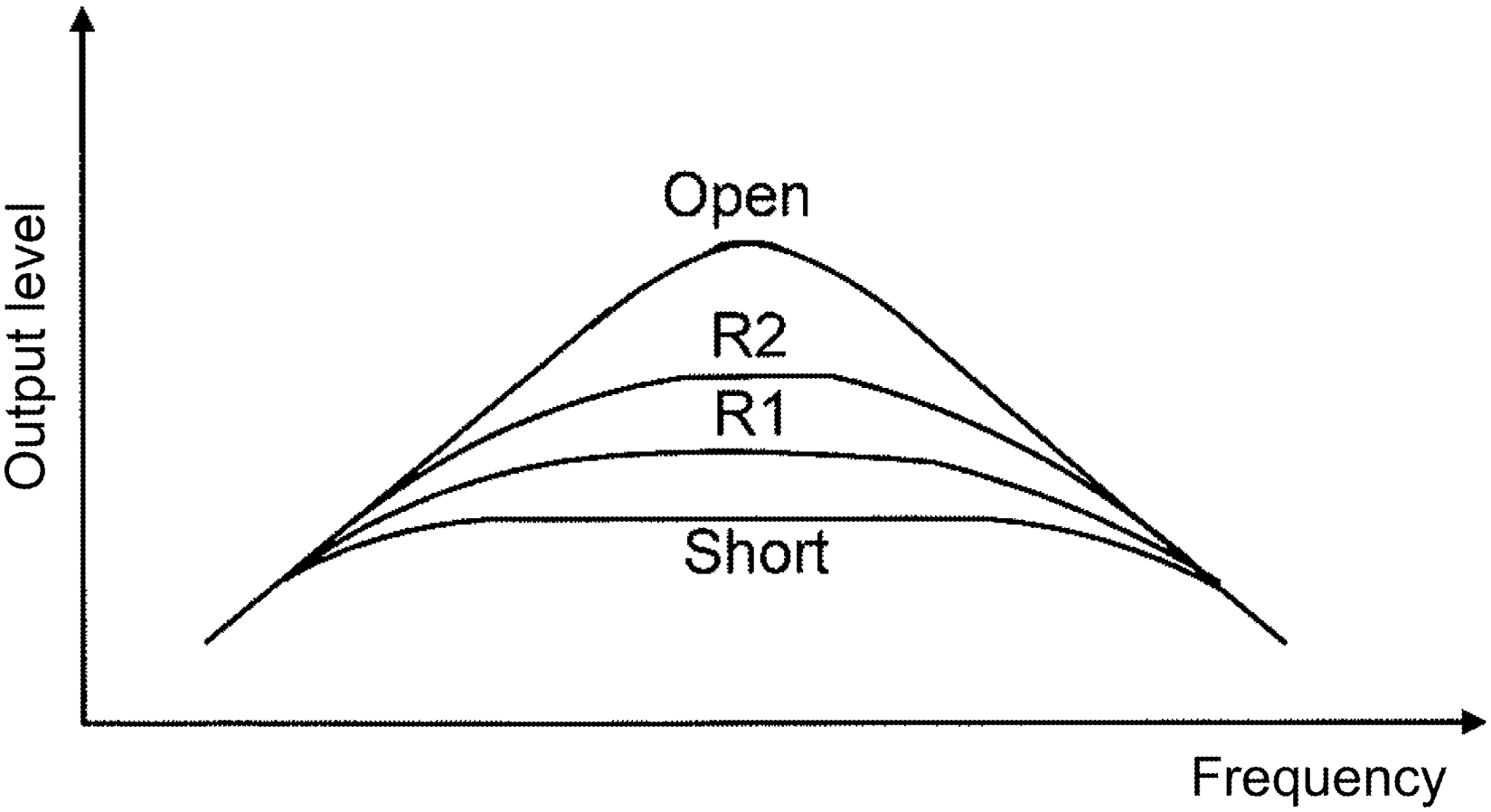
FIG. 2 is a graph of frequency responses of the signal converter.

FIG. 2 is a graph of frequency responses of an output level of the signal converter 1 with respect to the plug 50. When the fixed contact point Sb0 is selected by the movable contact Sa, the first end and the second end of the second coil 42 are turned into open state. In this state, no current flows through the second coil 42, making the braking force acting on the diaphragm 31 minimum. As a result, the Q-value becomes maximum in the frequency response. When the fixed contact point Sb1 is selected by the movable contact Sa, the resistance R2 is inserted between the first end and the second end of the second coil 42. In this state, current flows through the second coil 42, causing the braking force acting on the diaphragm 31 to increase and the Q-value to decrease. When the fixed contact point Sb2 is selected by the movable contact Sa, the resistance R1, which is smaller in resistance value than the resistance R2, is inserted between the first end and the second end of the second coil 42. In this state, the current flowing through the second coil 42 increases, causing the braking force acting on the diaphragm 31 to increase and the Q-value to further decrease. When the fixed contact point Sb3 is selected by the movable contact Sa, the first end and the second end of the second coil 42 are short-circuited. In this state, the current flowing through the second coil 42 becomes maximum, making the braking force acting on the diaphragm 31 maximum. As a result, the Q-value becomes minimum.

With this configuration of the embodiment, the user is able to switch the Q-value of the signal converter 1 by handling the movable contact Sa of the variable resistor 60. Thus, the user is able to adjust the Q-value of the signal converter 1 to a desired value.

A possible method of adjusting the Q-value is to connect a variable resistor to the first coil 41 in parallel with a microphone amplifier, and to use this variable resistor to adjust the current flowing through the first coil 41 so as to adjust the force of braking the diaphragm 31. It is to be noted, however, about this method that if the resistance value of the variable resistor connected to the first coil 41 is reduced, the output level (the input level of the microphone amplifier) with respect to the plug 50 might decrease. Contrarily, in this embodiment, the variable resistor 60 is connected to the second coil 42, which is different from the first coil 41 (which is for obtaining an electric signal that is based on vibration of the diaphragm 31), and the current for braking the diaphragm 31 is passed through the second coil 42. This configuration ensures that the Q-value can be adjusted by adjusting the force of braking the diaphragm 31 without impairing the conversion efficiency of the signal converter 1.

Other Embodiments

It is to be noted that the above-described embodiment has been provided for exemplary purposes only and that there are various other possible embodiments, some of which will be described below.

(1) In the above-described embodiment, the resistance value of the variable resistor 60 is manually switchable. Another possible embodiment is to provide another variable resistor different from the variable resistor 60 in the signal converter, instead of the variable resistor 60. The another variable resistor includes a variable resistance element (such as a digital potentiometer) whose resistance value is variable based on an electric signal.

(2) In the above-described embodiment, the first coil 41 is connected to an amplifier having high input impedance, and thus not much current flows through the first coil 41. The second coil 42, however, is connected with the variable resistor 60 at the first end and the second end of the second coil 42, and thus large braking current flows through the second coil 42. Also, if the current flowing through the second coil 42 is increased, it is possible to obtain greater electromagnetic braking. In view of this, it is possible to make the cross-sectional area of the winding of the second coil 42 larger than the cross-sectional area of the winding of the first coil 41, thereby making the resistance value per unit length of the winding of the second coil 42 smaller than the resistance value per unit length of the winding of the first coil 41.

(3) In musical instrument performance, it is possible to switch the resistance value of the variable resistor 60 by operating an operator such as a foot pedal.

While an embodiment of the present disclosure and modifications of the embodiment have been described, the embodiment and the modifications are intended as illustrative only and are not intended to limit the scope of the present disclosure. It will be understood that the present disclosure can be embodied in other forms without departing from the scope of the present disclosure, and that other omissions, substitutions, additions, and/or alterations can be made to the embodiment and the modification. Thus, these embodiments and modifications thereof are intended to be encompassed by the scope of the present disclosure. The scope of the present disclosure accordingly is to be defined as set forth in the appended claims.

What is claimed is:

1. A signal converter comprising:

a magnetic circuit having a magnetic gap;

a diaphragm disposed over an opening of the magnetic circuit;

a first coil disposed in the magnetic gap and configured to output an electrical signal based on vibration of the diaphragm;

a second coil disposed in the magnetic gap and configured to brake the diaphragm; and a variable resistor connected to a first end and a second end of the second coil and configured to form a closed loop circuit together with the second coil, wherein the variable resistor includes a variable resistance element having a resistance value that varies based on an electric signal.

2. The signal converter according to claim 1, wherein a winding of the second coil is smaller in resistance value per unit length than a winding of the first coil.

3. The signal converter according to claim 1, wherein the magnetic circuit comprises:

a chamber having an opening at one end;

a permanent magnet disposed at a bottom surface of the chamber opposite the opening; and an inner yoke disposed on the permanent magnet.

4. The signal converter according to claim 3, wherein the diaphragm is disposed over the inner yoke and covers the inner yoke.

5. The signal converter according to claim 3, wherein the permanent magnet includes an S-magnetic surface and an N-magnetic surface, wherein one of the S-magnetic surface and the N-magnetic surface is disposed on the bottom surface of the permanent magnet, and wherein the inner yoke is disposed on the other of the S-magnetic surface and the N-magnetic surface.

6. The signal converter according to claim 1, further comprising a voice coil bobbin provided on an outer periphery of the diaphragm and disposed in the magnetic gap, wherein the first coil is wound around the voice coil bobbin, and wherein the second coil is wound around an outside of the first coil.

7. The signal converter according to claim 1, further comprising a voice coil bobbin provided on an outer periphery of the diaphragm and disposed in the magnetic gap, wherein the first coil is wound around the voice coil bobbin.

8. A signal converter comprising:

a magnetic circuit having a magnetic gap;

a diaphragm disposed over an opening of the magnetic circuit;

a first coil disposed in the magnetic gap and configured to output an electrical signal based on vibration of the diaphragm;

a second coil wound around an outside of the first coil, disposed in the magnetic gap, and configured to brake the diaphragm; and a variable resistor connected to a first end and a second end of the second coil and configured to form a closed loop circuit together with the second coil.

9. The signal converter according to claim 8, wherein a winding of the second coil is smaller in resistance value per unit length than a winding of the first coil.

10. The signal converter according to claim 9, wherein the variable resistor includes a variable resistance element having a resistance value that varies based on an electric signal.

11. The signal converter according to claim 8, wherein the variable resistor includes a variable resistance element having a resistance value that varies based on an electric signal.

12. The signal converter according to claim 8, wherein the magnetic circuit comprises:

a chamber having an opening at one end;

a permanent magnet disposed at a bottom surface of the chamber opposite the opening; and an inner yoke disposed on the permanent magnet.

13. The signal converter according to claim 12, wherein the diaphragm is disposed over the inner yoke and covers the inner yoke.

14. The signal converter according to claim 12, wherein the permanent magnet includes an S-magnetic surface and an N-magnetic surface, wherein one of the S-magnetic surface and the N-magnetic surface is disposed on the bottom surface of the permanent magnet, and wherein the inner yoke is disposed on the other of the S-magnetic surface and the N-magnetic surface.

* * * * *